US007585258B2

(12) United States Patent
Watson et al.

(10) Patent No.: US 7,585,258 B2
(45) Date of Patent: Sep. 8, 2009

(54) POWER SENSING EDDY CURRENT RESISTANCE UNIT FOR AN EXERCISE DEVICE

(75) Inventors: Edward M. Watson, Madison, WI (US); David L. Wendt, Janesville, WI (US); Clint D. Kolda, Sioux Falls, SD (US)

(73) Assignee: Saris Cycling Group, Inc., Madison, WI (US)

( * ) Notice: Subject to any disclaimer, the term of this patent is extended or adjusted under 35 U.S.C. 154(b) by 0 days.

(21) Appl. No.: 11/930,916

(22) Filed: Oct. 31, 2007

(65) Prior Publication Data

US 2008/0103030 A1 May 1, 2008

Related U.S. Application Data

(63) Continuation of application No. 11/387,416, filed on Mar. 23, 2006.

(60) Provisional application No. 60/751,776, filed on Dec. 20, 2005, provisional application No. 60/664,343, filed on Mar. 23, 2005.

(51) Int. Cl.

| | |
|---|---|
| ***A63B 22/06*** | (2006.01) |
| ***A63B 22/08*** | (2006.01) |
| ***A63B 69/16*** | (2006.01) |
| ***A63B 21/005*** | (2006.01) |
| *A63B 21/015* | (2006.01) |

(52) U.S. Cl. ..... 482/63; 482/61; 482/903; 188/159

(58) Field of Classification Search ..... 482/51, 482/57, 63, 1, 4–7, 61, 65, 903; 73/379.07, 73/849, 779, 862.193, 862.331–862.336; 188/159, 161–164; *A63B 69/16, 22/06, 22/08, A63B 21/005*

See application file for complete search history.

(56) References Cited

U.S. PATENT DOCUMENTS

| | | | | |
|---|---|---|---|---|
| 3,831,942 | A * | 8/1974 | Del Mar | 482/72 |
| 4,423,630 | A * | 1/1984 | Morrison | 73/379.01 |
| 4,934,692 | A * | 6/1990 | Owens | 482/8 |

(Continued)

*Primary Examiner*—Loan H Thanh
*Assistant Examiner*—Oren Ginsberg
(74) *Attorney, Agent, or Firm*—Boyle Fredrickson, S.C.

(57) ABSTRACT

An exercise system includes a user input arrangement; a rotatable member that rotates in response to an input force applied by a user on the user input arrangement; a power sensing arrangement that senses power applied to the rotatable member due to the input force applied by the user; and a variable resistance arrangement interconnected with the power sensing arrangement and with the user input arrangement. The resistance arrangement applies resistance to rotation of the rotatable member, and is variable in response to the power sensing arrangement to vary the resistance applied to the rotatable member. The variable resistance arrangement may be a brake that interacts with the rotatable member to resist rotation of the rotatable member, and to thereby resist the input force applied by the user. The variable resistance arrangement includes a controller for controlling the brake in response to the power sensing arrangement.

19 Claims, 12 Drawing Sheets

U.S. PATENT DOCUMENTS 5,067,710 A * 11/1991 Watterson et al. ..... 482/3
5,165,278 A * 11/1992 Huszczuk et al. ..... 73/379.06
5,267,925 A * 12/1993 Boyd ..... 482/64
5,739,425 A * 4/1998 Binnig et al. ..... 73/105
6,066,075 A * 5/2000 Poulton ..... 482/8
6,234,939 B1 5/2001 Moser et al.
6,418,797 B1 7/2002 Ambrosina et al.
6,695,752 B2 * 2/2004 Lee ..... 482/63
6,964,633 B2 * 11/2005 Kolda et al. ..... 482/63
7,011,607 B2 3/2006 Kolda et al.
2002/0160883 A1 * 10/2002 Dugan ..... 482/8
2003/0073546 A1 4/2003 Lassanske et al.
2003/0158016 A1 8/2003 Kolda et al.
2005/0014994 A1 * 1/2005 Fowler et al. ..... 600/102
2005/0064999 A1 * 3/2005 Qiu ..... 482/57

* cited by examiner

POWER SENSING EDDY CURRENT RESISTANCE UNIT FOR AN EXERCISE DEVICE

CROSS-REFERENCE TO RELATED APPLICATION

This application is a continuation of application Ser. No. 11/387,416 filed Mar. 23, 2006, which claims the benefit of provisional patent application Ser. No. 60/751,776 filed Dec. 20, 2005, and provisional patent application Ser. No. 60/664,343 filed Mar. 23, 2005, the disclosures of which are hereby incorporated by reference.

BACKGROUND AND SUMMARY OF THE INVENTION

This invention relates to an exercise device or system that incorporates a rotating member for resisting input forces applied by a user, and more particularly to a resistance control arrangement for use in such an exercise device or system.

Many exercise devices utilize a rotating member that rotates in response to the application of input power by a user. In an exercise device of this type, it is common to provide resistance to rotation of the rotating member in order to provide resistance to the user. One example of an exercise device that incorporates a rotating member is a bicycle trainer, which includes a frame that supports the bicycle and a roller that engages the driven wheel of the bicycle. The rotating member may be in the form of a flywheel that is interconnected with the roller, and that rotates in response to rotation of the roller caused by rotation of the bicycle wheel. Another example of an exercise device that incorporates a rotating member is a stationary exercise cycle, which includes a frame having a seat and handlebars that support a user, in combination with a flywheel that is driven into rotation by operation of a pedal and chain assembly.

In a typical rotating member-type exercise device or system, a brake arrangement is used to resist rotation of the rotating member such that the rotating member presents a load in watts. The brake arrangement can be any type of brake, such as a magnetic or mechanical brake. In an electronic exerciser that incorporates a resistive load system, the resistors are modulated between ON and OFF states to brake the rotating member. The degree of resistance to rotation of the rotating member is typically controlled by the user, either manually or automatically. In a manual control system, the user selects a resistance setting and the brake arrangement is responsive to the user-selected setting to establish the resistance level. Changes in the level of resistance are accomplished during an exercise session by manually selecting desired settings at different times in the session. In an automatic system, the user selects a program and the resistance level is automatically varied during an exercise session to adjust resistance according to the program.

In the past, e.g. in a magnetic eddy current resistance unit, the position of one or more movable magnets relative to the rotating member is detected, and a lookup table is used to calculate resistance. In such a system, the various parameters are inputted into a controller, to calculate resistance based on magnet position. Systems of this type are functional but are highly inaccurate due to numerous variables that are involved in manufacture, assembly, engagement with the bicycle wheel (in the case of a bicycle trainer), and in operation of the power input system and the resistance unit. This type of system is "open", in that the system is first calibrated to correlate the magnet position to power, and the controller then alters the positions of the magnet(s) to provide a desired braking force according to the lookup table to create the desired load. The numerous variables significantly limit the accuracy of a system of this type.

In the case of an electronic resistance unit, the controller functions to control the duty cycle of the resistors, which controls the load experienced by the user. The duty cycle, in turn, is calibrated such that a certain duty cycle is determined to correspond to a certain load. Again, this is an open system, in that there is no actual measurement of power. The measurement is done in a laboratory to create the lookup table, and when a product is sold the same lookup table is used on all products. Due to the numerous process variations and other variables as noted above, it has been found that systems of this type have accuracy limitations on the order of 15-20%.

It is an object of the present invention to provide a rotating member resistance unit that includes the ability to control a user's power level in response to the degree of resistance applied to the rotating member. It is another object of the present invention to enable a user to monitor his or her own power output, and to control the applied resistance to provide a desired power output. Yet another object of the present invention is to provide control of the braking force that resists rotation of a rotating member in an exercise device resistance unit, regardless of the form of the braking mechanism. A further object of the invention is to measure and control the resistance applied to a rotating member in a resistance unit, which is used in combination with a desired power curve that may either be pre-programmed or inputted by the user, to enable a user to accurately achieve a desired power output.

In accordance with one aspect, the present invention contemplates an exercise system including a user input arrangement, a rotatable member that rotates in response to an input force applied by a user on the user input arrangement, and a power sensing arrangement configured to sense power applied to the rotatable member due to the input force applied by the user. The exercise system further includes a variable resistance arrangement interconnected with the power sensing arrangement and with the user input arrangement. The resistance arrangement is operable to apply resistance to rotation of the rotatable input member, and is variable in response to the power sensing arrangement to vary the resistance applied to the rotatable input member. The variable resistance arrangement may be in the form of a brake arrangement that interacts with the rotatable member to resist rotation of the rotatable member, and to thereby resist the input force applied by the user. The variable resistance arrangement includes a controller for controlling the brake arrangement in response to the power sensing arrangement. The power sensing arrangement is in the form of a resistance measuring arrangement for measuring the degree of resistance to rotation of the rotating member applied by the brake arrangement, to determine the power applied by the user to rotate the rotatable member.

The power sensing arrangement may also be in the form of a rotatable power sensing member interposed between the user input arrangement and the rotatable member. The rotatable power sensing member is preferably rotatable about an axis of rotation that is concentric with an axis of rotation about which the rotatable member is rotatable. Representatively, the power sensing member may be in the form of a power sensing hub member to which the rotatable member is mounted.

The rotatable member may be the wheel of a bicycle, and the resistance arrangement may be associated with a bicycle trainer that supports the bicycle. In this embodiment, the bicycle wheel is engaged with a roller that is interconnected with the resistance arrangement. The power sensing arrangement is carried by the bicycle, and senses power applied by the user on the user input arrangement for imparting rotation to the bicycle wheel. The power sensing arrangement is in the form of a power sensing hub to which the bicycle wheel is mounted. In another embodiment, the power sensing arrangement is associated with the bicycle trainer and senses power applied by the bicycle wheel for imparting rotation to the roller.

The rotatable member may also be in the form of a flywheel associated with an exercise cycle, in which the resistance arrangement acts on the exercise cycle flywheel to resist rotation of the exercise cycle flywheel. The power sensing arrangement may be in the form of a power sensing hub to which the flywheel is mounted. The power sensing arrangement may also be in the form of a resistance measuring arrangement for measuring the degree of resistance to rotation of the flywheel applied by the brake arrangement, to determine the power applied by the user to rotate the flywheel.

The invention also contemplates a method of controlling operation of a resistance arrangement incorporated in an exercise device or system, in which the exercise device or system includes a rotatable member that rotates in response to a user-applied input force, substantially in accordance with the foregoing summary. The invention further contemplates a resistance arrangement, also in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
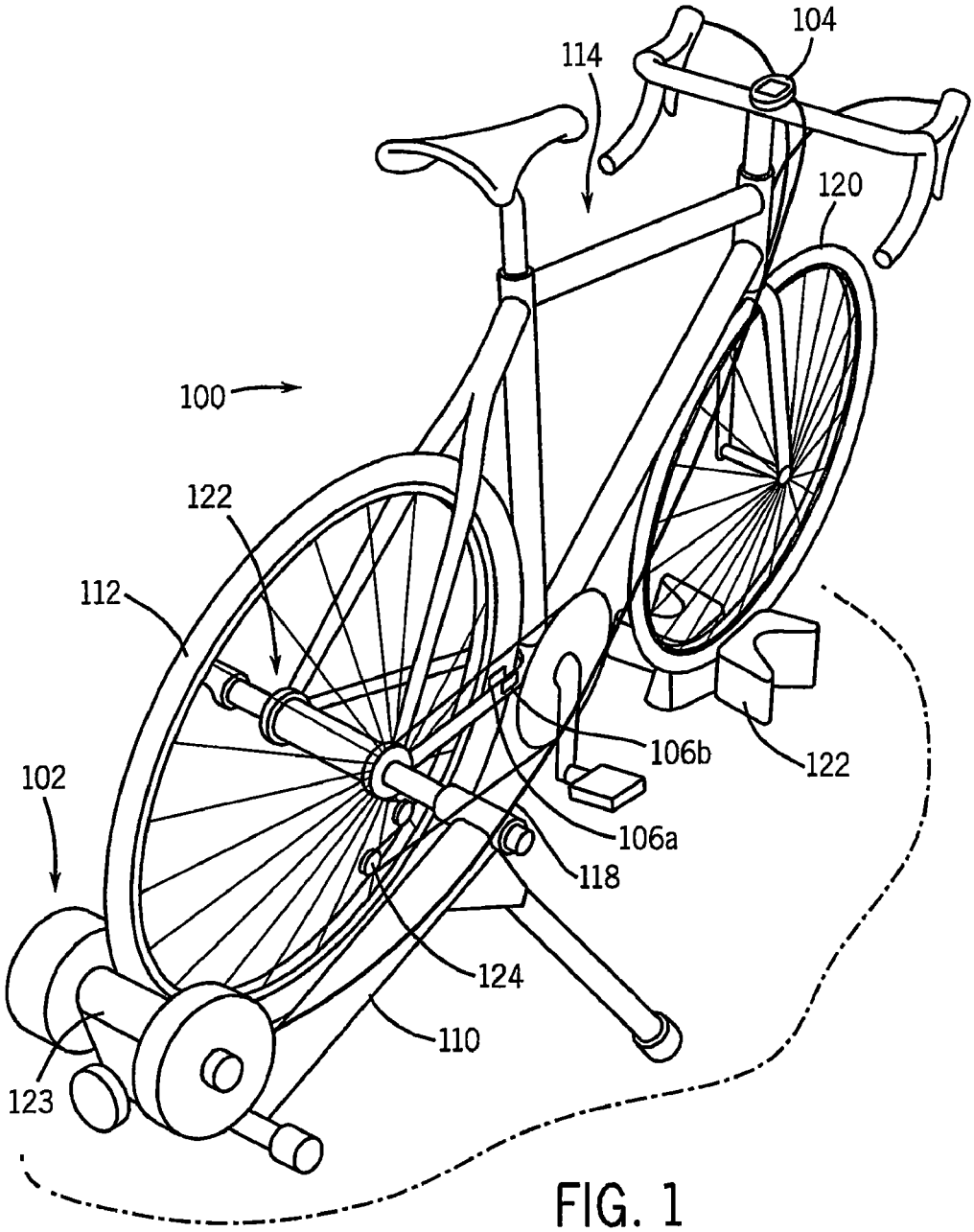
FIG. 1 is an isometric view of an exercise system, in the form of a bicycle secured to a bicycle trainer, incorporating en electronic resistance unit used in the closed loop resistance control of the present invention.

The present invention contemplates several embodiments of an exercise system or device. Each embodiment generally includes a rotating member, a resistance arrangement that either directly or indirectly resists rotation of the rotating member, a power input arrangement for causing rotation of the rotating member, a power sensing arrangement, and a resistance control that interacts with the resistance arrangement to set a resistance level based on the input power sensed by the power sensing arrangement.

In a first embodiment, an exercise system 100 includes a resistance unit 102 interconnected with a bicycle computer 104, which is mounted to a bicycle 114. Resistance unit 102 is held in position by a frame or support stand 110, which removably mounts a rear wheel 112 of bicycle 114, in a manner as is known. Bicycle trainers of this general type are available from Saris Cycling Group, Inc. of Madison, Wis. under its designation CycleOps.

Bicycle computer 104 and resistance unit 102 may be connected by a cable 118, although it is understood that a wireless communication system may also be employed. A rear wheel speed sensor 106*a* and a cadence sensor 106*b* may be interconnected with bicycle computer 104 via a cable, for inputting bicycle operating characteristics to bicycle computer 104, as is known. Rear wheel sensor 106*a* is located adjacent (or is coupled to) rear wheel 112 of bicycle 114, for measuring the speed of revolution of rear wheel 112. Cadence sensor 106*b* is located adjacent the bicycle pedal cranks, to measure the cadence of the user's pedal stroke. The front wheel 120 of bicycle 114 can be held in position by a riser block 122.

Resistance unit 102 includes a roller 123 that engages rear wheel 112. Resistance unit 102 provides variable resistance to rotation of rear wheel 112, according to a desired level of effort for the user. The resistance may be varied according to a predetermined program, such as is shown and described in Henderson et al U.S. Pat. No. 6,450,922, the disclosure of which is hereby incorporated by reference. Alternatively, the resistance applied by resistance unit 102 may be manually controlled by a user through bicycle computer 104, or the resistance applied by resistance unit 102 may be controlled through a resistance control separate from bicycle computer 104. Representatively, resistance unit 102 may be an electronic, magnetic or fluid resistance unit, as is known in the art.

Rear wheel 112 incorporates a power sensing arrangement in its hub, shown at 122. The power sensing hub 122 may be such as is shown and described in Ambrosina et al U.S. Pat. No. 6,418,797, incorporated herein by reference. Alternatively, power sensing hub 122 may be such as is shown and described in copending application Ser. No. 10/852,887 filed May 25, 2004, also incorporated herein by reference. Such power sensing hubs are available from Saris Cycling Group, Inc. of Madison, Wis. under the designation PowerTap.

In accordance with the invention, power sensing hub 122 is interconnected with resistance unit 102, as representatively illustrated by dashed line 124, which represents either a cable-type connection or a wireless connection. In either form, the connection 124 between power sensing hub 122 and resistance unit 102 communicates input torque or power signals from power sensing hub 122 to resistance unit 102, to control the resistance applied to rear wheel 112. The input power sensed by power sensing hub 122 is calculated by sensing the torque applied to hub 122 through the bicycle power input arrangement, i.e. the bicycle pedals, combined with information pertaining to the speed of rotation of the bicycle wheel 112, as detected by wheel speed sensor 106*a*. The sensed input torque or power information is communicated to resistance unit 102.

The input torque or power information from power sensing hub 122 is received by the controller of resistance unit 102, which employs the input torque or power information to improve the overall accuracy of the resistance applied to rear wheel 112 by resistance unit 102. The "closed" system established by communication between power sensing hub 122 and resistance unit 102 accounts for losses in the coupling between resistance unit 102 and rear wheel 112, to provide accurate control of resistance unit 102. That is, in a system such as this, the resistance unit is pushed up against the tire of the bicycle by the user, using a tensioning mechanism to which the resistance unit is mounted. This introduces a significant variable, in that the pressure between the tire and the roller of the resistance unit can significantly affect resistance to rotation of the tire. By using a power sensing hub to obtain power information, the inaccuracies introduced by variables of this type are eliminated.

Figure 2:
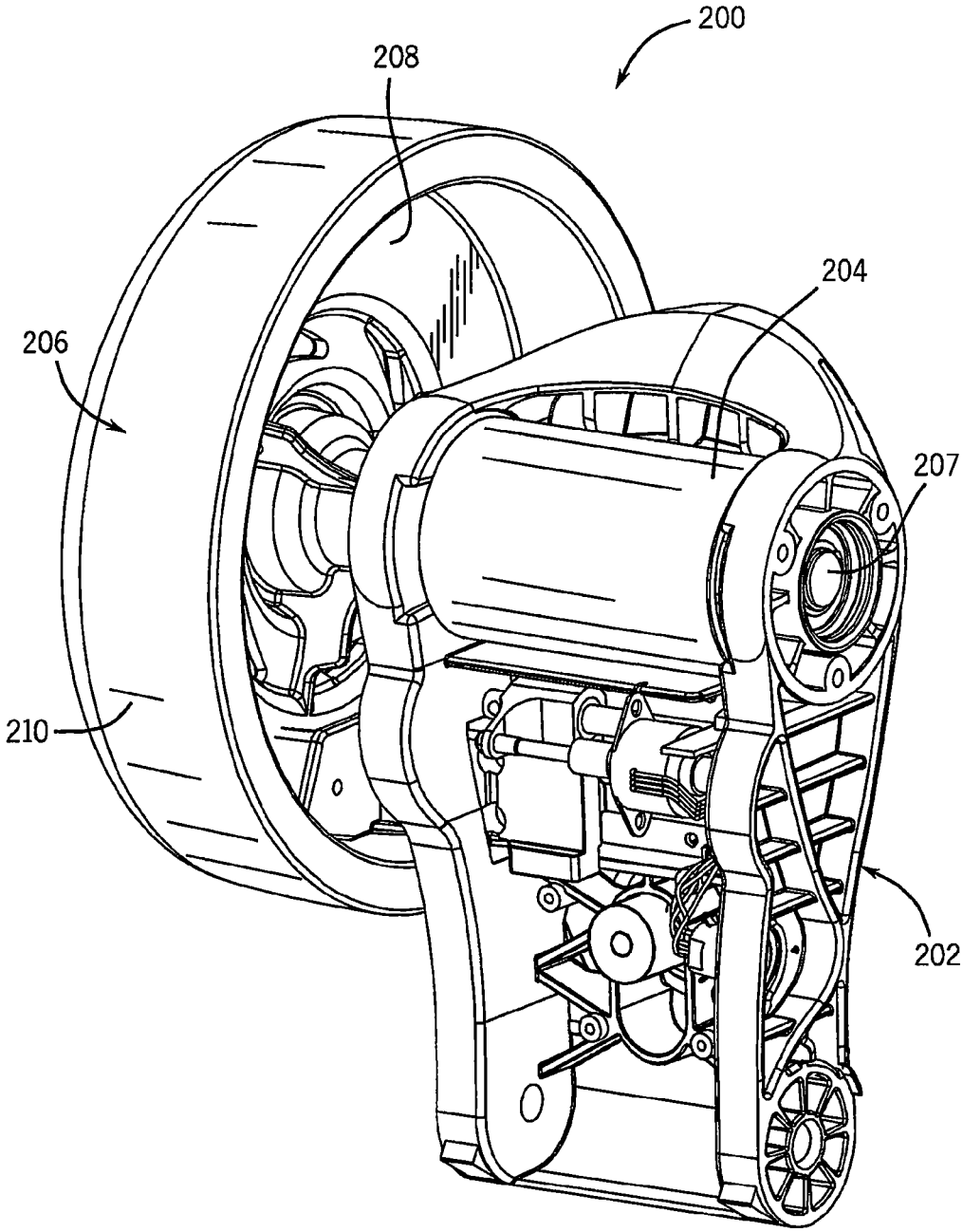
FIG. 2 is an isometric view of a first embodiment of a magnetic resistance unit for use in an exercise system, such as a bicycle trainer, for use in the closed loop resistance control of the present invention.
Figure 3:
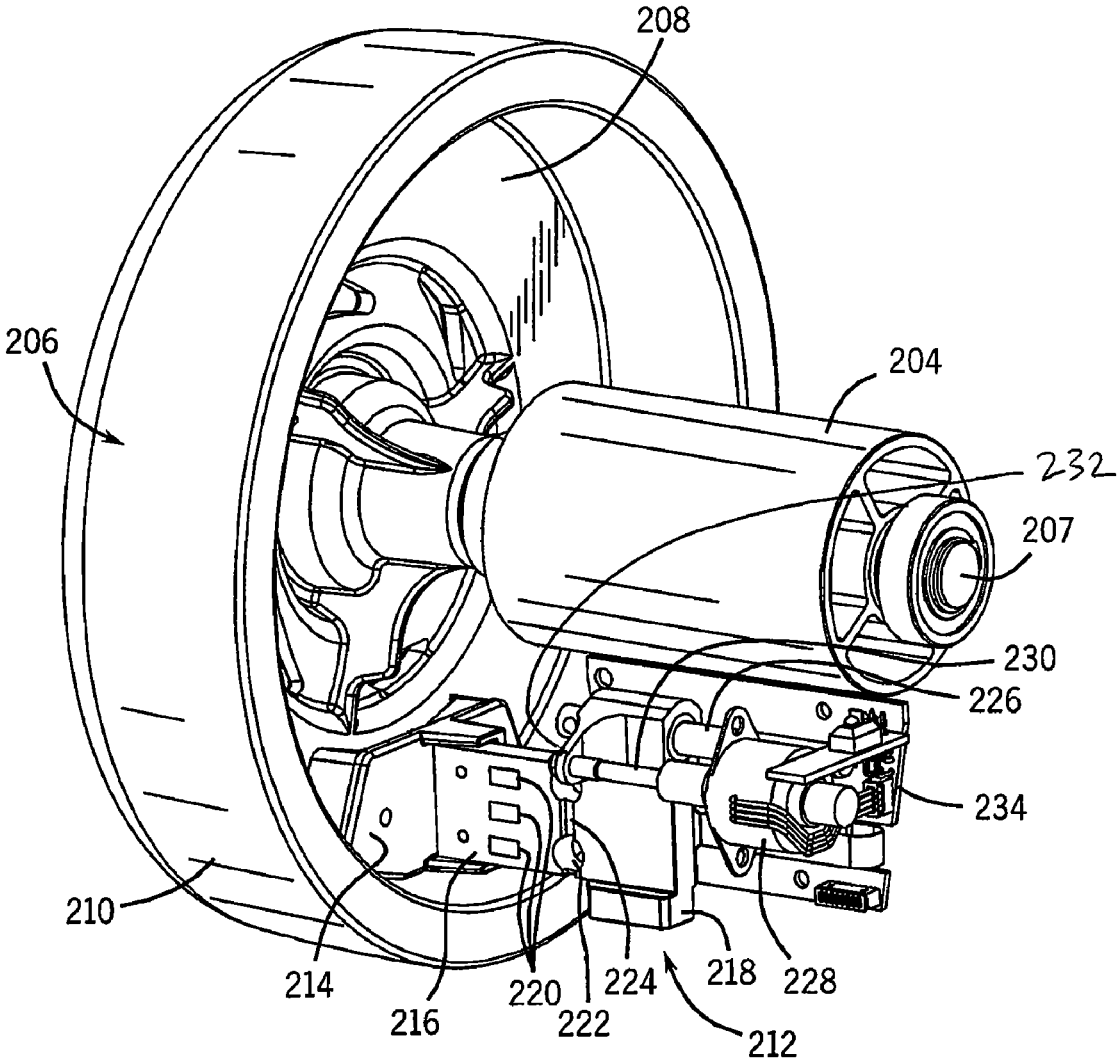
FIG. 3 is an enlarged partial isometric view of the components of the resistance unit of FIG. 3.

FIGS. 2 and 3 illustrate another application of the closed loop resistance control system of the present invention. In this embodiment, a magnetic resistance unit 200 is adapted for use in providing resistance to rotation of a bicycle wheel, such as 112 (FIG. 1). In a manner similar to resistance unit 102, resistance unit 200 is adapted for mounting to a trainer frame such as 110 via a yoke 202, and includes a roller 204 for engagement with the bicycle driven wheel, such as 112. Resistance unit 200 includes a flywheel 206, which is adapted to be driven into rotation in response to rotation of roller 204 caused by rotation of bicycle wheel 112. Representatively, roller 204 and flywheel 206 are mounted to a common shaft (the end of which is shown at 207), which is rotatably supported by bearings mounted to yoke 202. Flywheel 206 includes an inner annular conductive member 208 formed of an electrically conductive material, which is secured to a side wall of flywheel 206 located inwardly of an outer peripheral ring 210.

Magnetic resistance unit 200 includes a magnet assembly 212, which cooperates with conductive member 208 to establish eddy currents that resist rotation of flywheel 206 when flywheel 206 is rotated. Magnet assembly 212 is mounted to yoke 202, and includes a magnet carrier 214 to which one or more magnets are mounted so as to overlie conductive member 208. Magnet carrier 214 is secured to the outer end of a beam 216, the inner end of which is secured to a bracket 218. One or more strain gauges 220 are mounted to beam 216, and are adapted to sense strain experienced by beam 216 when flywheel 206 is rotated to establish eddy current resistance by the interaction between the magnets of magnet carrier 214 and conductive member 208. Beam 216 may be formed with openings such as 222 and an area 224 of reduced thickness, to increase the tendency of the outer area of beam 216 to bend upon application of eddy current resistance caused by rotation of flywheel 206, to thereby magnify the strain in the outer area of beam 216 and the accuracy of the readings of strain gauges 220.

Beam mounting bracket 218 is slidably mounted for inward and outward movement to a stationary guide post 226. A linear actuator, which may be in the form of a linear motor 228 having an output member 230, is operable to move bracket 218, and thereby beam 216 and magnet carrier 214, inwardly and outwardly relative to conductive member 208. Bracket 218 includes a tab or ear 232, to which the end area of motor output member 230 is secured. Motor 228 is operated by electronic components carried by a circuit board 234, to selectively move magnet carrier 214 relative to conductive member 208. As is known, the proximity of the magnets of magnet carrier 214 relative to conductive member 208 determines the strength of the eddy current resistance when flywheel 206 is rotated. When the magnets of magnet carrier 214 are closer to conductive member 208, the eddy current resistance is greater than when the magnets of magnet carrier 214 are positioned a greater distance from conductive member 208.

In operation, the embodiment of the present invention illustrated in FIGS. 2 and 3 functions as follows. When flywheel 206 is rotated by rotation of roller 204 caused by rotation of bicycle wheel 112, the eddy currents established by the interaction between conductive member 208 and the magnets of magnet carrier 214 resist rotation of flywheel 206. The forces experienced by magnet carrier 214 cause flexure strain in beam 216, which is measured by strain gauges 222. The strain experienced by beam 216 is proportional to the degree of eddy current resistance to rotation of flywheel 206, which thus provides a measurement of the force required to rotate flywheel 206 since the degree of resistance to rotation of flywheel 206 is equal and opposite to the force required to rotate flywheel 206. A conventional speed sensor (such as a reed switch and magnet sensor) may be used to determine the speed of rotation of flywheel 206, which enables calculation of the power required to rotate flywheel 206 on a real time basis. With this information, the position of magnet carrier 214 can be controlled to provide a desired power value. In this system, an adjustment in the resistance is accomplished simply by adjusting the position of magnet carrier 214 relative to conductive member 208.

While the drawings illustrate use of a linear motor to adjust the position of magnet carrier 214, it is understood that other motive devices may be used to move magnet carrier 214, including but not limited to piezo actuators, muscle wires (shape memory alloys that change in length when a voltage is applied), or nano-muscles.

Figure 4:
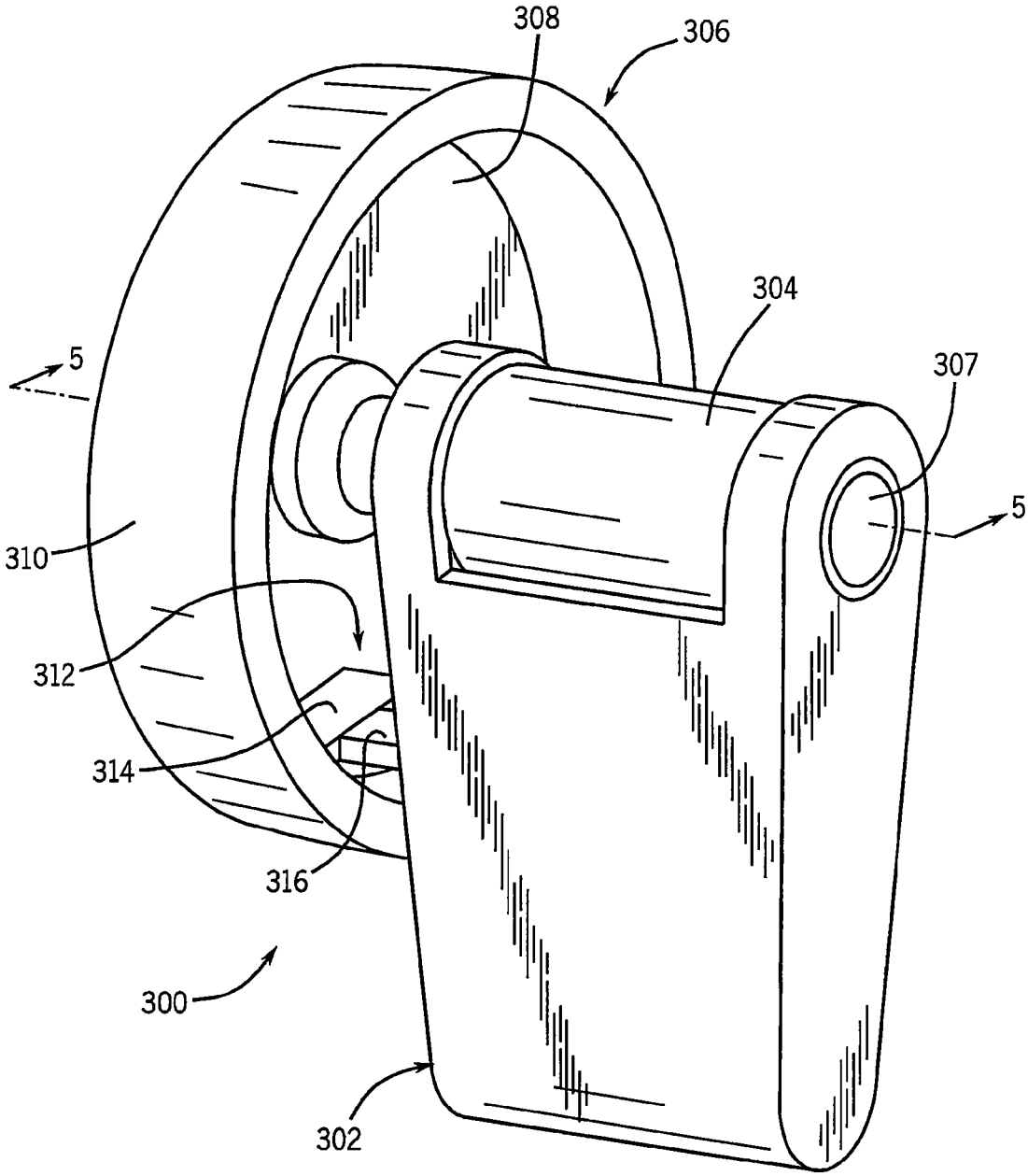
FIG. 4 is an isometric view of a second embodiment of a magnetic resistance unit for use in an exercise system, such as a bicycle trainer, for use in the closed loop resistance control of the present invention.
Figure 5:
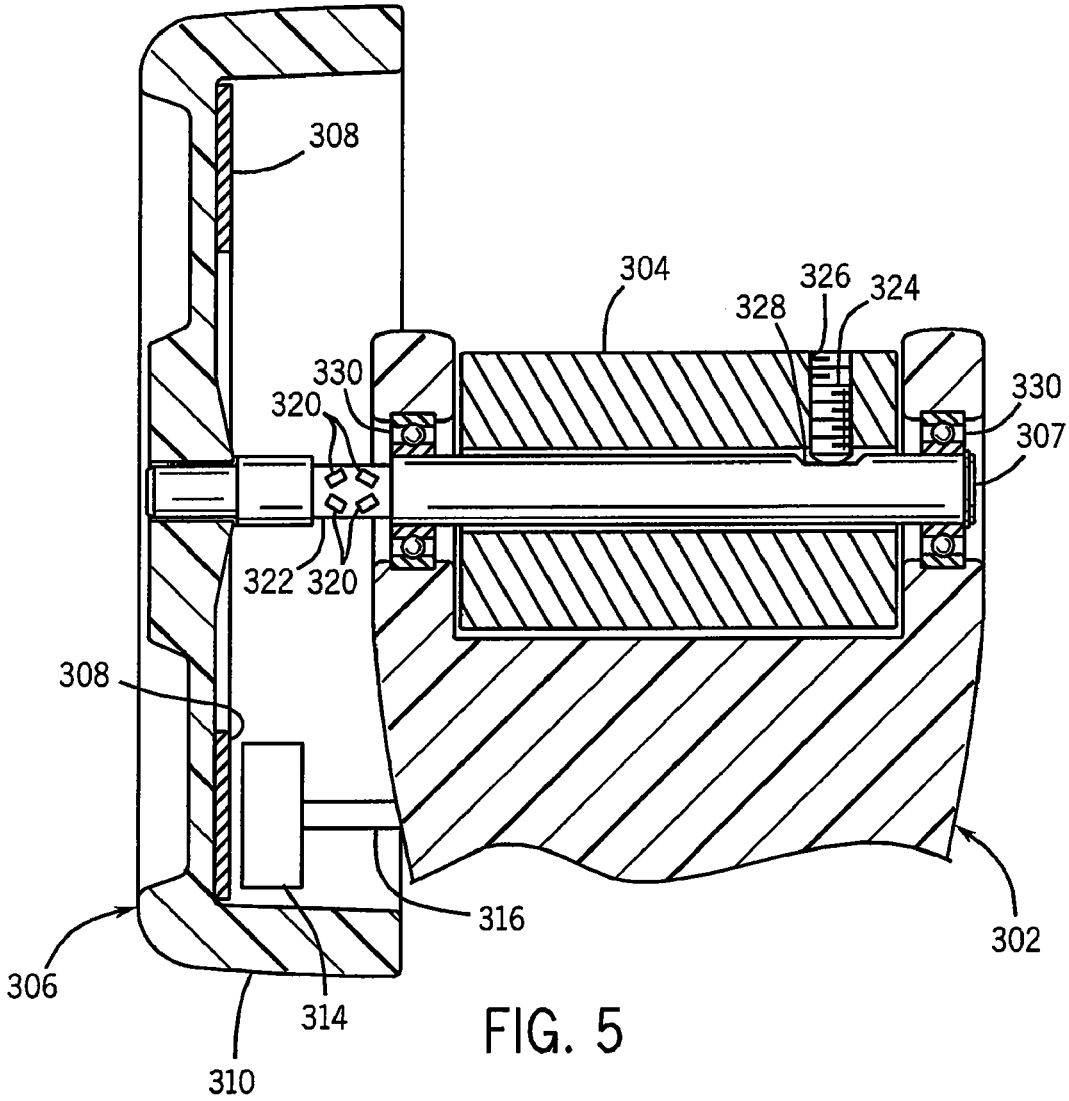
FIG. 5 is a partial longitudinal section view of the resistance unit of FIG. 5.

In another embodiment of the present invention as illustrated in FIGS. 4 and 5, a magnetic resistance unit 300 is adapted for use in providing resistance to rotation of a bicycle wheel, such as 112 (FIG. 1). In a manner similar to resistance unit 102, resistance unit 300 is adapted for mounting to a trainer frame such as 110 via a yoke 302, and includes a roller 304 for engagement with the bicycle driven wheel, such as 112. Resistance unit 300 includes a flywheel 306, which is adapted to be driven into rotation in response to rotation of roller 304 caused by rotation of bicycle wheel 112. Representatively, roller 304 and flywheel 306 are mounted to a common shaft (the end of which is shown at 307), which is rotatably supported by bearings mounted to yoke 302. Flywheel 306 includes an inner annular conductive member 308 formed of an electrically conductive material, which is secured to a side wall of flywheel 306 located inwardly of an outer peripheral ring 310.

Magnetic resistance unit 300 includes a magnet assembly 312, which cooperates with conductive member 308 to establish eddy currents that resist rotation of flywheel 306 when flywheel 306 is rotated. Magnet assembly 312 is mounted to yoke 302, and includes a magnet carrier 314 to which one or more magnets are mounted so as to overlie conductive member 308. Magnet carrier 314 is secured to the outer end of a beam 316, the inner end of which is secured to a bracket, which is slidably mounted for inward and outward movement in a manner similar to that describe with respect to FIGS. 2 and 3. A linear actuator or the like is operable to move the bracket, and thereby beam 316 and magnet carrier 314, inwardly and outwardly relative to conductive member 308. As is known, the proximity of the magnets of magnet carrier 314 relative to conductive member 308 determines the strength of the eddy current resistance when flywheel 306 is rotated. When the magnets of magnet carrier 314 are closer to conductive member 308, the eddy current resistance is greater than when the magnets of magnet carrier 314 are positioned a greater distance from conductive member 308.

In this embodiment, a rotational torque sensor is used to determine the degree of resistance to rotation of flywheel 306 by magnet assembly 312. As shown in FIG. 5, the rotational torque sensor may be in the form of a series of strain gauges 320 secured to shaft 307 at a reduced diameter area 322 of shaft 307. Strain gauges 320 are connected to conventional power and communication electronic components (not shown), which are mounted to shaft 307 and rotate with shaft 307. Stationary power and communication electronic components (not shown) are mounted to yoke 302, and are inductively coupled to the rotating power and communication electronic components to provide power to strain gauges 320 and to communicate the strain signals from strain gauges 320.

Shaft 307 is secured to roller 304 such that rotation of roller 304 causes rotation of shaft 307, which in turn transfers such rotation to flywheel 306. In the illustrated embodiment, a set screw 324 extends into a threaded passage 326 formed in roller 304, and bears against a flat area 328 formed on shaft 307 so as to non-rotatably secure roller 304 and shaft 307 together. It is understood, however, that shaft 307 and roller 304 may be non-rotatably secured together in any other satisfactory manner. A pair of bearing assemblies 330 are secured to the end of yoke 302, and are operable to rotatably mount shaft 307, and thereby roller 304, to the end of yoke 302.

In operation, the embodiment of the present invention illustrated in FIGS. 4 and 5 functions as follows. When flywheel 306 is rotated by rotation of roller 304 caused by rotation of bicycle wheel 112, the eddy currents established by the interaction between conductive member 308 and the magnets of magnet carrier 314 resist rotation of flywheel 306. The resistive forces experienced by the outer area of flywheel 306 cause torsional strain in shaft 307, since shaft 307 is between roller 304 (which is the location at which the input power is applied) and flywheel 306 (which is the location at which the resistive load is applied). The reduced diameter area 322 of shaft 307, at which torsion strain gauges 320 are mounted, provides a localized area at which torsional strain experienced by shaft 207 is magnified, to facilitate strain readings that are obtained by strain gauges 320. The torsional strain in shaft 307 is measured by torsion strain gauges 320, and is proportional to the degree of eddy current resistance to rotation of flywheel 306, which thus provides a measurement of the force required to rotate flywheel 306 since the degree of resistance to rotation of flywheel 306 is equal and opposite to the force required to rotate flywheel 306. A conventional speed sensor (such as a reed switch and magnet sensor) may be used to determine the speed of rotation of flywheel 306, which enables calculation of the power required to rotate flywheel 306 on a real time basis. With this information, the position of magnet carrier 314 can be controlled to provide a desired power value. In this system, an adjustment in the resistance is accomplished simply by adjusting the position of magnet carrier 314 relative to conductive member 308.

Another embodiment of the present invention is illustrated in FIGS. 6-10. In this embodiment, a cycling exerciser, shown generally at 420, includes an actuator assembly 422 for braking and for resistance adjustment. In the illustrated embodiment, the actuator assembly 422 is a cable-type actuator assembly that allows for a single caliper actuation cable 424 to be actuated by either a brake cable 426 or a resistance adjustment cable 428 of the cycling exerciser 420. In a manner as set forth in copending application Ser. No. 11/192,506 filed Jul. 29, 2005 and PCT application serial number PCT/US2005/027134 filed Jul. 29, 2005, the disclosures of which are hereby incorporated by reference, cable-type actuator assembly 22 can be used to actuate a resistance mechanism 430, such as a caliper-type mechanism including brake pads 431, or other resistance means on cycling exerciser 420.

Cycling exerciser 420 includes a self-supporting frame 432. Attached to frame 432 are an adjustable seat 434, a flywheel or wheel 436 and handlebars 438. Frame 432 can take a variety of configurations, and is shown in the illustrated embodiment as a rear wheel spin bike incorporating a "forkless frame." Frame 432 is generally diamond-shaped and includes a neck 433, an upper frame member 435, a lower frame member 437, an upright seat support 440 and a rear fork 442. A front support member 444 and a rear support member 446 are connected to frame 432 and elevate frame 432 off the ground or other support surface, such that wheel 436 spins freely in the air. Support members 444, 446 may also include feet 448 to raise the frame 432 off the ground. A transport wheel 450 may also be included to assist a user in moving the cycling exerciser 420.

Handlebars 438 are adjustably attached to the front of the frame 432 above neck 433. Handlebars 438 include at least one right handle 454 and one left handle (not shown). Handlebars 438 may additionally include an alternative upright right handle 452 and upright left handle (not shown), which can be utilized when a rider desires a more upright riding position when exercising.

Cycling exerciser 420 includes a user power input, in the form of a conventional crank-type pedal assembly 451 rotatably mounted to frame 432 below seat 434. Pedal assembly 451 includes a chain ring or sprocket 453, which in turn drives a chain in a manner as is known. In a manner to be explained, the chain is engaged with a rear hub to which flywheel 436 is mounted, so as to impart rotation to flywheel 436 in response to the application of user input power to pedal assembly 451.

At least one brake lever or hand brake 456 is connected to either the left handle or the right handle 454. Hand brake 456 may be of the conventional type and is operably connected to brake cable 426 in a manner known in the art. Brake cable 426 is a sheath-type tension actuating cable having a conventional construction and operation. Sheath 458 and brake cable 426 extend downwardly from handlebars 438 in a direction towards the upper frame member 435 of the cycle frame 432.

A resistance adjustment mechanism 470 is attached to the handlebars 438. Resistance adjustment mechanism 470 can take a variety of configurations. In the illustrated embodiment, resistance adjustment mechanism 470 is in the form of an adjustment knob connected to a resistance adjustment controller 472, which in turn is connected to the end of resistance adjustment cable 428. Resistance controller 472 is selectively operable to selectively tension and release adjustment cable 428, to control the resistance to rotation of flywheel 436 applied by resistance mechanism 430. With this construction, the user is able to select certain resistance settings using resistance adjustment mechanism 470, and resistance adjustment controller 472 is operable to tension or release cable 428 to adjust the resistance to rotation of flywheel 436 applied by resistance mechanism 428. Alternatively, resistance adjustment mechanism 470 may be in the form of a computer-based selection mechanism, such as a computer touch screen or up/down button arrangement, with which the user interfaces to select a resistance level. In this embodiment, the resistance controller 472 is responsive to the resistance selection to selectively tension or release cable 428.

Figure 7:
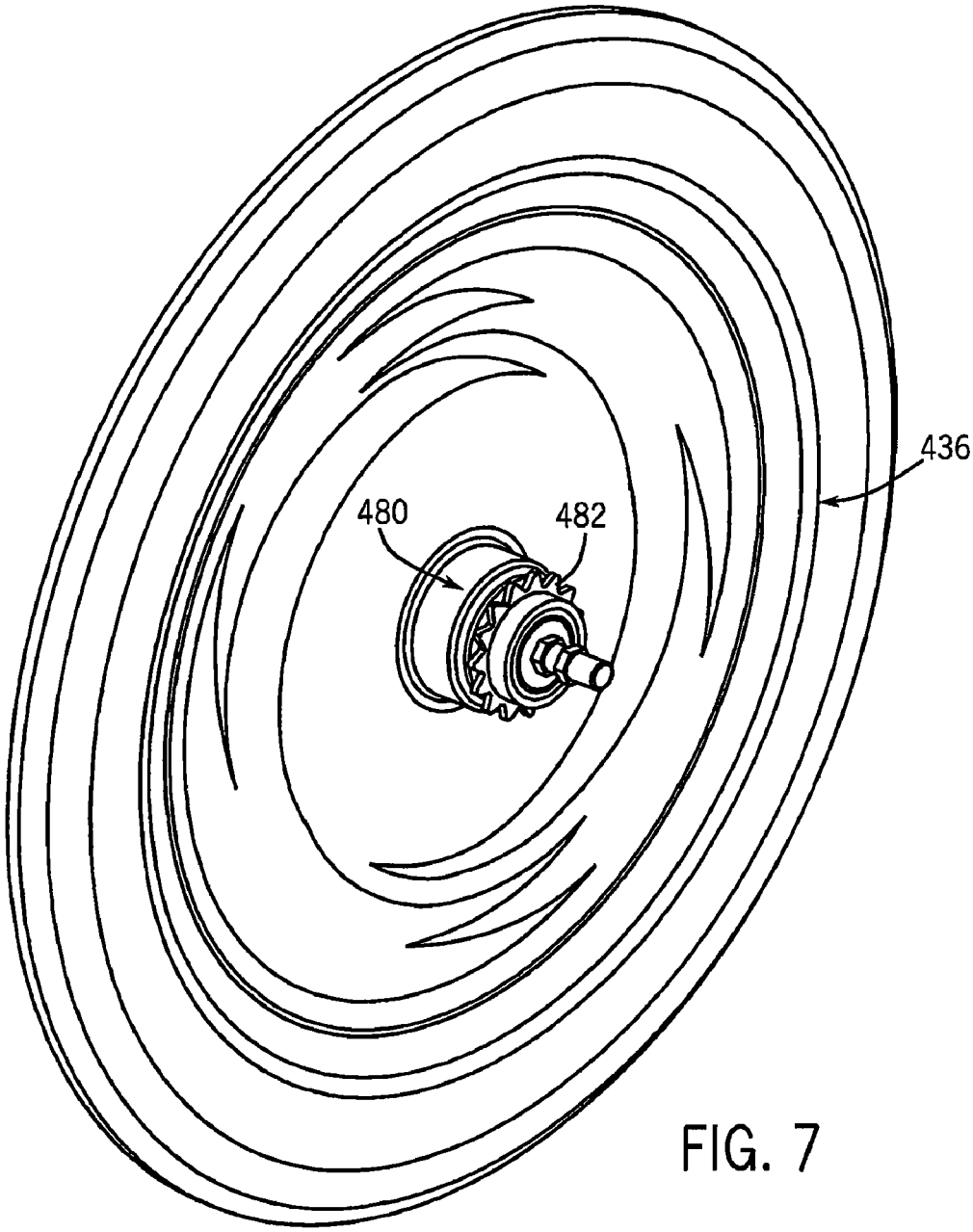
FIG. 7 is an isometric view of a flywheel incorporated in the exercise cycle of FIG. 6.

FIG. 7 illustrates flywheel 436, which incorporates a hub 480 that is rotatably supported by frame 432. Hub 480 includes a sprocket 482 at one side, which is engaged with the chain so as to rotate hub 480, and thereby flywheel 436, in response to user operation of pedal assembly 451.

Figure 6:
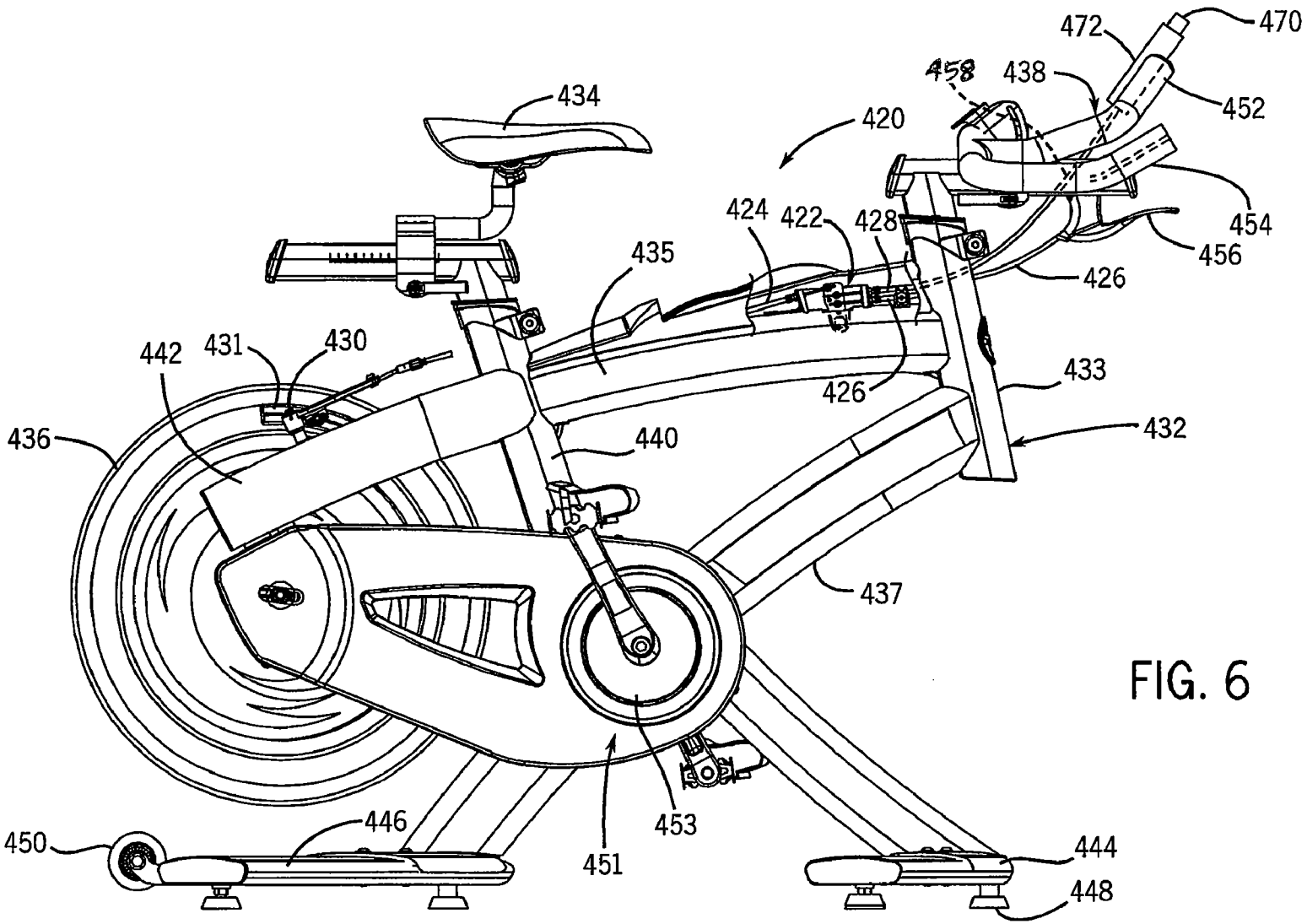
FIG. 6 is an elevation view of an exercise device, in the form of an exercise cycle, incorporating the closed loop resistance control of the present invention.
Figure 8:
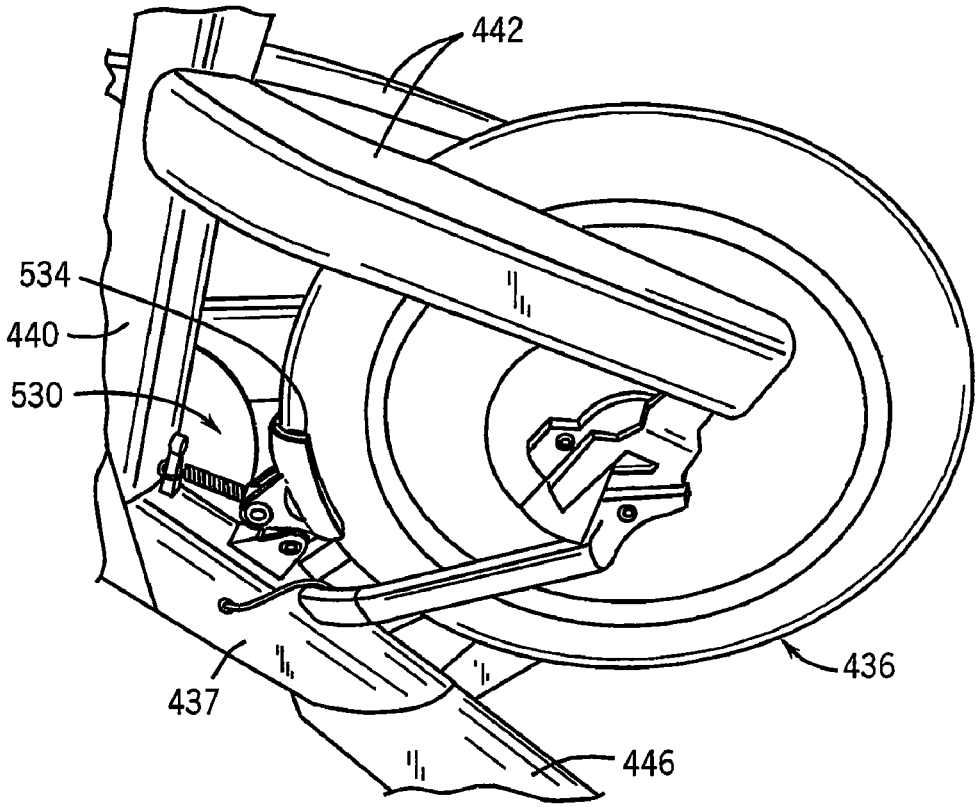
FIG. 8 is a partial isometric view of the flywheel of FIG. 7 and its interconnection with the frame of the exercise cycle of FIG. 6, showing a resistance application arrangement for use in one embodiment of a closed loop resistance control of the present invention used in a stand-alone exercise device.
Figure 9:
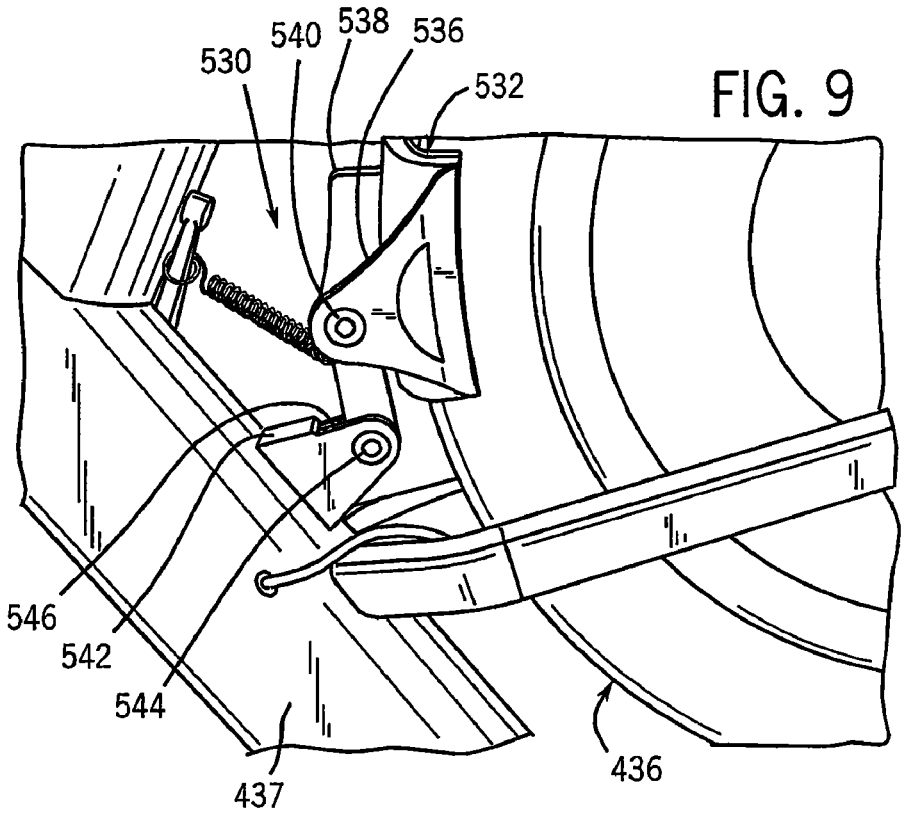
FIG. 9 is an enlarged partial isometric view of the resistance application arrangement of FIG. 8.
Figure 10:
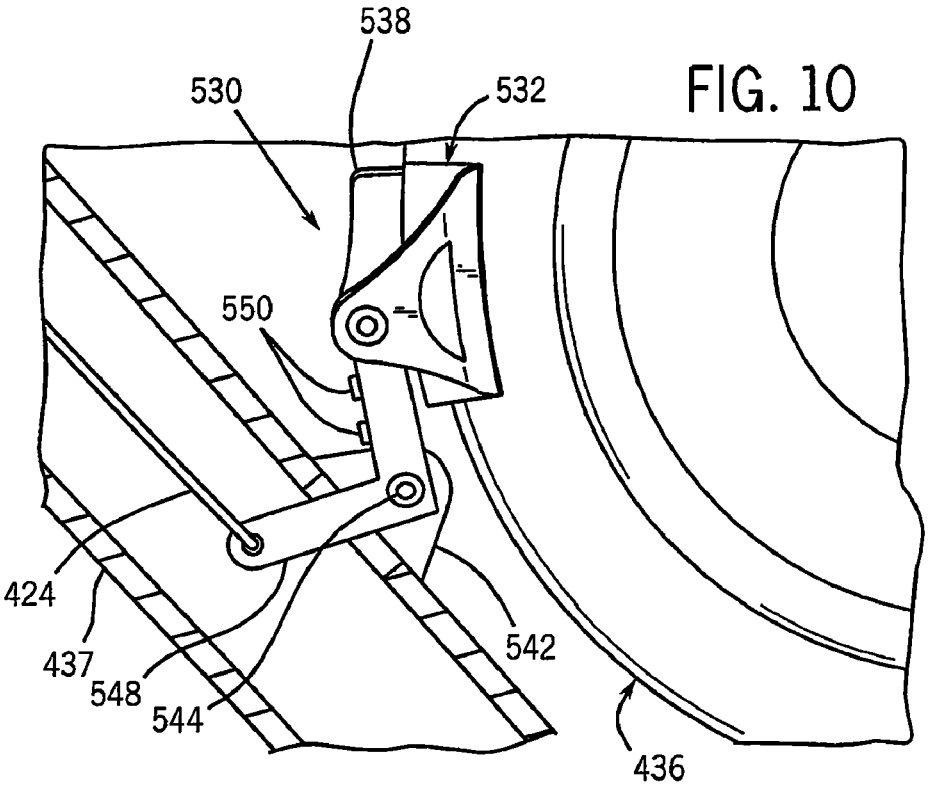
FIG. 10 is a schematic representation of the resistance application arrangement of FIG. 9.

FIGS. 8 and 9 illustrate an alternative resistance mechanism, shown generally at 530, which may be used in place of the caliper-type resistance mechanism 430 as illustrated in FIG. 6. Resistance mechanism 530 includes a brake member 532, which has a generally V-shaped or U-shaped cross section and is configured to bear on the outer edge of flywheel 436, to provide resistance to rotation of flywheel 436. Brake member 532 defines an inner surface to which a brake pad 534 is mounted, to provide a cushion between brake member 532 and flywheel 436. Brake member 532 further includes a pair of mounting ears 536, between which an actuating arm 538 is located. Arm 538 is pivotably mounted between ears 536 via a pivot connection 540. The inner end of arm 538 is pivotably mounted to a mounting member 542 via a pivot connection 544. Mounting member 542 includes a slot 546 within which the inner end of actuating arm 538 is located. Slot 546 is in communication with the interior of lower frame member 437. With this construction, an inner arm 548 (FIG. 10) secured to the inner end of actuating arm 538 is connected to the end of actuating cable 424, to selectively apply or release pressure on the edge of flywheel 436 via brake member 532.

One or more strain gauges 550 are mounted to actuating arm 538 in order to measure the strain in actuating arm 538, which is a reaction to the pressure applied to flywheel 436 by brake member 532. That is, there is a direct correspondence between the strain in actuating arm 538 and the resistive force applied by brake member 532 on flywheel 436.

In operation, the embodiment of the present invention as illustrated in FIGS. 6-10 functions as follows. When flywheel 436 is rotated by operation of pedal assembly 451, the force applied to the edge of flywheel 436 by brake member 532 resists rotation of flywheel 436. The reactive force in actuating arm 538 is measured by the strain gauges 550, and is proportional to the degree of resistance to rotation of flywheel 436, which thus provides a measurement of the force required to rotate flywheel 436 since the degree of resistance to rotation of flywheel 436 is equal and opposite to the force required to rotate flywheel 436. A conventional speed sensor (such as a reed switch and magnet sensor) may be used to determine the speed of rotation of flywheel 436, which enables calculation of the power required to rotate flywheel 436 on a real time basis. With this information, the tension on actuating cable 424 can be controlled to provide a desired power value. In this system, an adjustment in the resistance is accomplished simply by adjusting the tension of actuating cable 424, which controls the pressure applied by brake member 532 on the edge of flywheel 436.

Figure 11:
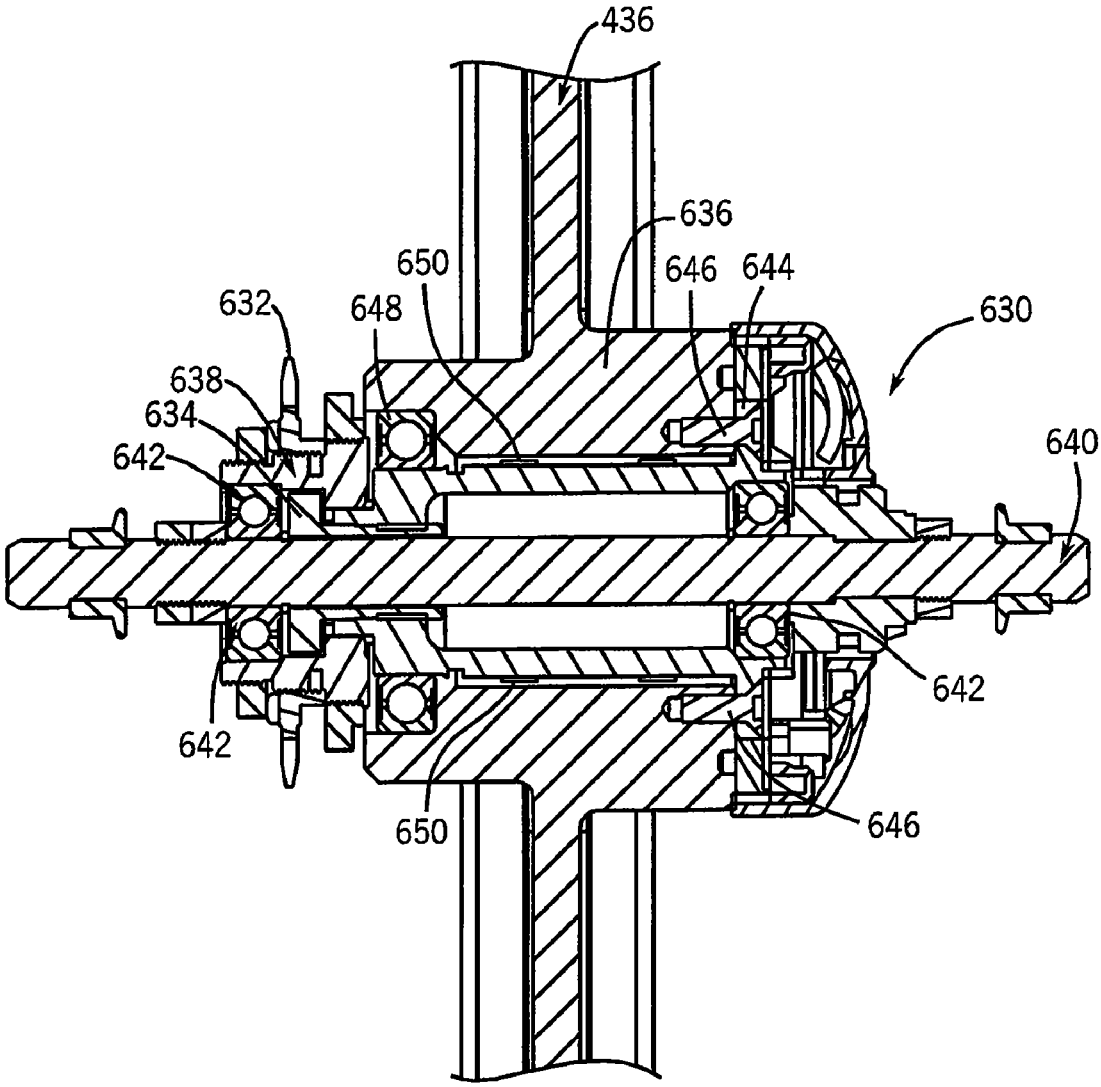
FIG. 11 is a partial section view through the hub of the flywheel as in FIG. 7, showing another embodiment of a closed loop resistance control of the present invention used in a stand-alone exercise device.
Figure 12:
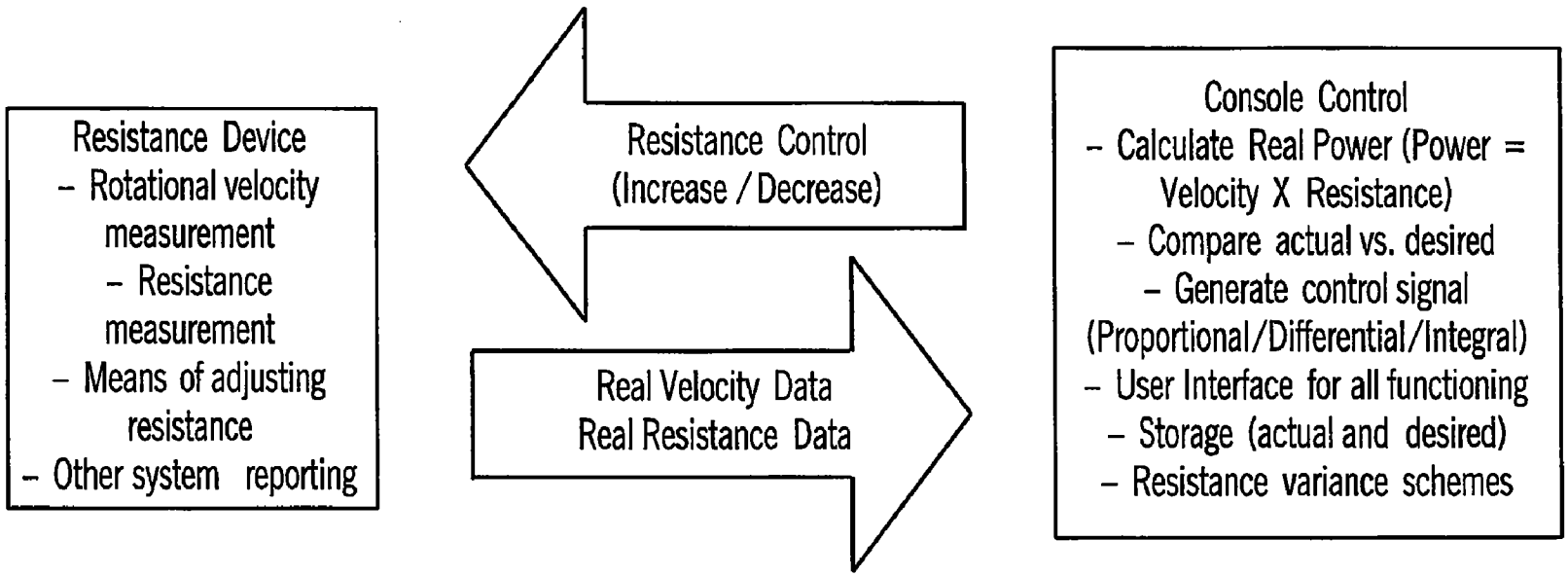
FIG. 12 is a schematic flow diagram illustrating operation of the closed loop resistance control of the present invention.
Figure 13:
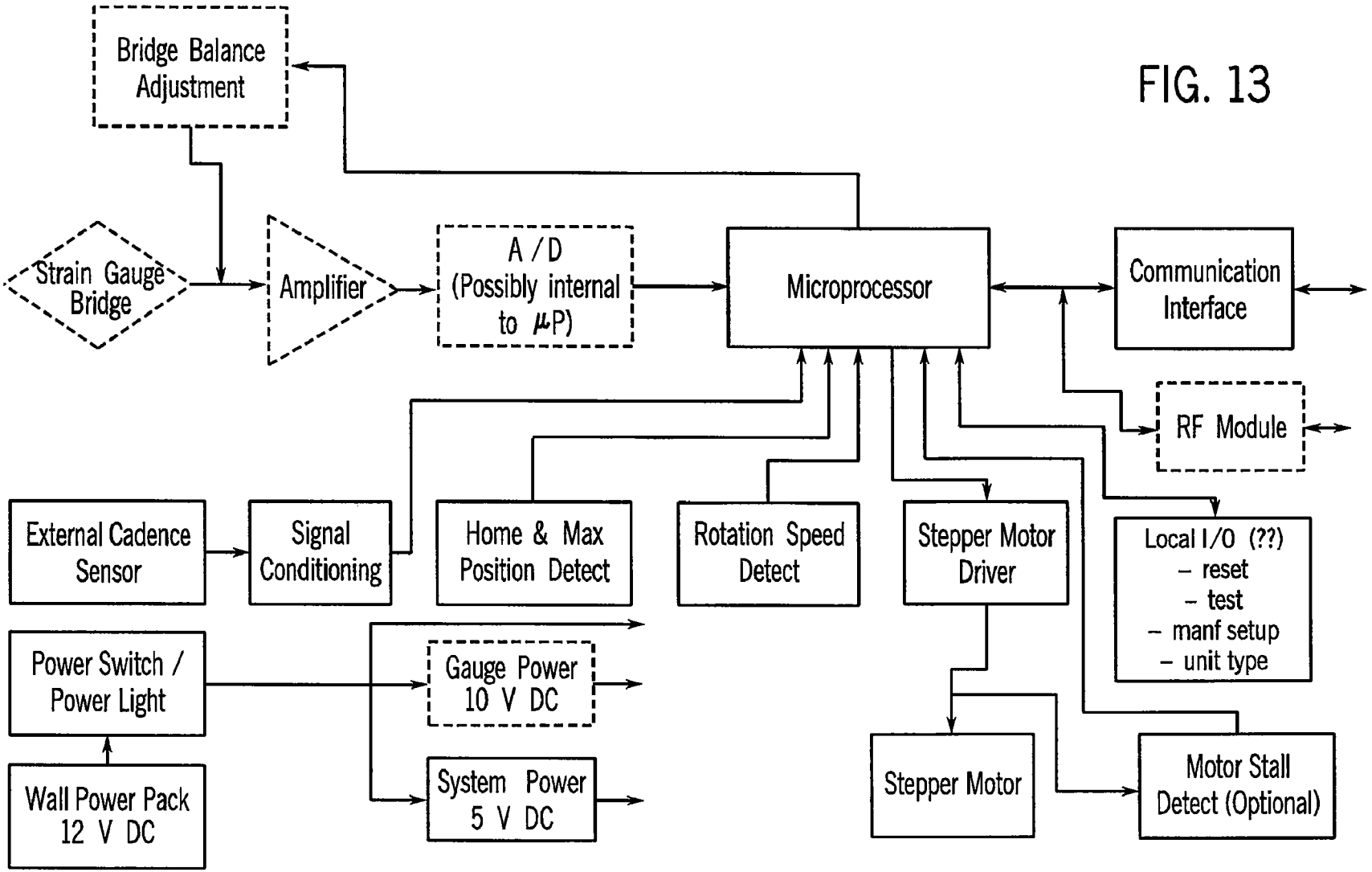
FIG. 13 is a flow chart schematic diagram illustrating the electronic components of a closed loop resistance control in accordance with the present invention.

Another embodiment of the present invention is illustrated in FIG. 11. In this embodiment, the power measuring or sensing arrangement is in the form of a power sensing hub 630 that functions to rotatably mount flywheel 436 of cycling exerciser 420 to frame 432. Power sensing hub 630 includes a sprocket 632 at one side, which is engaged with the chain so as to rotate hub 630, and thereby flywheel 436, in response to user operation of pedal assembly 51.

In the illustrated embodiment, power sensing hub 630 includes an inner torque tube 634 that is secured at one end to sprocket 632. Flywheel 436 includes an inner hub area 636, which defines a transverse passage through which inner torque tube 634 extends. Sprocket 632 is mounted to an adapter 638. An axle or spindle 640 extends transversely through adapter 638 and inner torque tube 634, and functions to mount flywheel 436 to frame 432, in a manner as is known. A pair of bearings 642 rotatably support inner torque tube 634 on axle or spindle 640. Inner torque tube 636 defines an annular outer flange 644 at the end opposite sprocket 632, which is mounted via screws 646 to inner hub area 636 of flywheel 436. A bearing 648 is located between inner torque tube 634 and the opposite end of inner hub area 636, to accommodate relative rotational movement between inner torque tube 634 and inner hub area 636.

A series of strain gauges 650 are mounted to inner torque tube 634, and sense the strain in inner torque tube 634 during the transfer of rotary power from sprocket 632 to flywheel 436. In a manner as is known, the strain experienced by torque tube 634 corresponds to torque applied to torque tube 634 by the user through pedal assembly 451 and the chain, which is used in combination with the speed of rotation of flywheel 436 to calculate input power.

Power sensing hub 630 may have a construction as shown and described in U.S. Pat. No. 6,418,797 entitled Apparatus and Method for Sensing Power in a Bicycle, the disclosure of which is hereby incorporated by reference. Bicycle power sensing hubs of this type are available from Saris Cycling Group, Inc. of Madison, Wis. under the designation PowerTap.

In operation, the embodiment of the present invention as illustrated in FIG. 11 functions as follows. When flywheel 436 is rotated by operation of pedal assembly 451, the force applied to the edge of flywheel 436 by brake member 532 resists rotation of flywheel 436. The reactive force experienced by flywheel 436 is measured by the strain gauges 650, and is proportional to the degree of resistance to rotation of flywheel 436, which thus provides a measurement of the force required to rotate flywheel 436 since the degree of resistance to rotation of flywheel 436 is equal and opposite to the force required to rotate flywheel 436. The strain signals are communicated wirelessly to a CPU or other controller. A conventional speed sensor (such as a reed switch and magnet sensor) may be used to determine the speed of rotation of flywheel 436, which enables calculation of the power required to rotate flywheel 436 on a real time basis. With this information, the tension on actuating cable 424 can be controlled to provide a desired power value. In this system, an adjustment in the resistance is accomplished simply by adjusting the tension of actuating cable 424, which controls the pressure applied by brake member 532 on the edge of flywheel 436.

While the power sensing feature of the present invention has been shown and described in connection with sensing power applied to rotating flywheel in a cycling exerciser or bicycle trainer, it is understood that the power sensing feature of the invention may be used in connection with a rotating member in any type of exercise device. For example, and without limitation, the power sensing function may be incorporated in an intermediate rotating member between the user power input and the resistance-providing member, e.g. the flywheel or other rotating member which supplies resistance or to which resistance is applied. In addition, while the invention has been shown and described in connection with resistance being applied to a flywheel or rotating bicycle wheel, it is understood that resistance to the user power input may be provided in any part of the drive system that is driven in response to the input of power by the user. Resistance may be applied by any resistive arrangement that acts on and/or resists rotation of a rotating member, or may be applied by a fluid, magnetic, wind or other known type of resistance-providing arrangement that is capable of providing a braking forced on a rotating member. The power sensing function may be provided in any type of exercise device that has a rotating member that is rotated in response to the application of input power by a user, e.g. a rowing exerciser, a swim stroke exerciser, a stair climbing exerciser, an elliptical trainer, etc. The input power may be rotary input power, as in the pedal-type input as shown and described, or a linear power input, or any other type of user-operated input by which a user applies input power to an exercise device. The power sensing function may be accomplished any satisfactory type of power sensing arrangement. The power sensing function may be accomplished at a rotating member that is driven by the user power input, e.g. in the bottom bracket of a pedal-type input wherein the user imparts rotation to a rotary power sensing device that is rotatably supported on the exerciser frame (a "bottom bracket" power sensing application). This is in contrast to prior art power sensing devices that sense input power using the pedal crank arms of a pedal-type input.

In an application of the closed loop system of the present invention, the resistive force on the rotating member can then be adjusted so that, if the console or controller is set for a predetermined power value, e.g. 300 watts, the controller is operated to operate the resistance mechanism to apply roughly 300 watts, e.g. according to a lookup table. The force on the resistance mechanism is then continuously measured, and the resistance mechanism is continuously adjusted to attain the exact desired wattage.

With the present invention, the actual applied resistance is measured and the measurement is incorporated into the control loop. Typically, the resistance measurement may be used in combination with a lookup table that provides a rough approximation of the desired resistance, and power is then measured as described above. The power measurement is then used to provide an error signal to determine the difference between the desired setting and the actual setting, and the controller then adjusts resistance accordingly.

In practice, the system of the invention provides a closed loop, real time system that continually senses and adjusts resistance to provide the desired power output. In this system, the accuracy is limited only by the accuracy of the measurement device. The user is able to adjust a power setting, and the resistance control, in whatever form, adjusts resistance continuously during operation to accommodate changing parameters, e.g. temperature or other variables. For example, if the user establishes a power setting of 300 watts on the console of the exercise device, the resistance mechanism will adjust to provide the desired constant 300 watt setting (to the capability of the measurement device). In the event conditions change, e.g. speed of rotation of the wheel, temperature, cadence, etc., the resistance mechanism continuously compensates and controls the unit to 300 watts. The same holds true for a variable power setting, in that the control continuously adjusts resistance to provide the desired variable power setting.

In a basic embodiment of the present invention, the resistance unit is pre-programmed to provide a desired power curve during operation. The resistance is measured as above, and the resistive force is controlled to provide the desired power curve during operation of the resistance unit. This option gives the end user the ability to later upgrade to a system that includes a user input or feedback arrangement. Also, a system such as this enables a user to program a desired power curve into the resistance unit, and then transport the device with the resistance unit to another location (e.g. to a race) for use in pre-race warm up, leaving the console at home. The user can change the power curve to any provide any desired power curve.

Another version may include a display with feedback. Various pre-programmed courses and fitness settings are programmed into the controller. Power (in watts) is displayed via a calibrated watts table or measured as described above.

Yet another version may include a WIFI antenna that interacts live with the user's computer network. The wireless option can be used in a home setting, or in a club setting to allow several users to interact with each other.

Various alternatives and embodiments are contemplated as being within the scope of the following claims particularly pointing out and distinctly claiming the subject matter regarded as the invention.

We claim:

1. A power sensing resistance arrangement for an exercise device that includes an input area for applying user input power, comprising:

a rotatable member that rotates in response to the application of the user input power to the input area, wherein the input area comprises a pedal arrangement, wherein the rotatable member rotates about an axis of rotation in response to the application of user input power to the pedal arrangement;

a conductive member associated with the rotatable member, wherein the conductive member is formed of an electrically conductive material and rotates in response to rotation of the rotatable member; and a magnet assembly which cooperates with the conductive member to establish eddy currents to resist rotation of the rotatable member, wherein the magnet assembly includes a magnet carrier having one or more magnets located adjacent the conductive member at a location radially offset from the axis of rotation; a nonrotatable beam having a supported inner end and an unsupported outer end, wherein the inner end of the beam is fixed and wherein the magnet carrier is secured to the beam at a location axially outwardly of the supported inner end of the beam; and one or more strain sensing members interconnected with the beam between the magnet carrier and the supported inner end of the beam, wherein the beam, the magnet carrier and the one or more strain sensing members are configured and arranged such that the magnet carrier is spaced outwardly from the one or more strain sensing members in an axial direction parallel to the axis of rotation, and wherein the beam, the magnet carrier and the one or more strain sensing members are spaced radially outwardly from the axis of rotation, and wherein the one or more strain sensing members are configured and arranged to sense strain experienced by the beam when the rotatable member is rotated to establish eddy current resistance by the interaction between the magnets of the magnet carrier and the conductive member, wherein the strain in the beam corresponds to the user input power.

2. The resistance arrangement of claim 1, wherein the rotatable member comprises a wheel of an exercise cycle, wherein the input area comprises a pedal arrangement associated with the exercise cycle.

3. The resistance arrangement of claim 1, wherein the magnet assembly comprises a mounting member secured to the inner end of the beam, wherein the mounting member is configured to support the inner end of the beam, and wherein the one or more strain sensing members comprise one or more strain gauges secured to the beam outwardly of the mounting member.

4. The resistance arrangement of claim 3, wherein the beam includes an area of reduced thickness to increase the tendency of the outer end of the beam to bend upon application of eddy current resistance.

5. The resistance arrangement of claim 3, further comprising means for causing relative movement between the magnet carrier and the conductive member for varying the magnitude of the eddy current forces caused by rotation of the conductive member relative to the magnet carrier.

6. The resistance arrangement of claim 5, wherein the means for causing relative movement between the magnet carrier and the conductive member comprises a linear actuator interconnected with the mounting member, wherein the linear actuator is operable to axially move the beam, and thereby the magnet carrier, toward and away from the conductive member.

7. The resistance arrangement of claim 6 wherein the linear actuator comprises a linear motor having an output member interconnected with the mounting member.

8. The resistance arrangement of claim 7 wherein the mounting member comprises a bracket that includes a tab, wherein the output member is secured to the tab.

9. The resistance arrangement of claim 8, wherein the linear motor is operated by electronic components carried by a circuit board to selectively move the magnet carrier relative to the conductive member.

10. A method of controlling a resistance arrangement of an exercise system that includes an input area for applying user input power, wherein the exercise system includes a rotatable member that rotates in response to a user-applied input force at the input area, comprising the steps of:

rotating the rotatable member about an axis of rotation in response to application of the user-applied input force to the input area, wherein the input area comprises a pedal arrangement, wherein rotation of the rotatable member in response to the application of input power to the pedal arrangement causes rotation of a conductive member; and resisting the rotation of the rotatable member through the use of eddy currents established by interaction of the conductive member and a magnet arrangement, wherein the magnet arrangement includes a magnet carrier having one or more magnets located adjacent the conductive member at a location radially offset from the axis of rotation; a nonrotatable beam having a supported inner end and an unsupported outer end, wherein the inner end of the beam is fixed and wherein the magnet carrier is secured to the beam at a location axially outwardly of the unsupported inner end of the beam, wherein the beam, the magnet carrier and the one or more strain sensing members are configured and arranged such that the magnet carrier is spaced outwardly from the one or more strain sensing members in an axial direction parallel to the axis of rotation, and wherein the beam, the magnet carrier and the one or more strain sensing members are spaced radially outwardly from the axis of rotation; and sensing strain in the beam using one or more strain sensing members when the rotatable member is rotated to establish eddy current resistance by the interaction between the magnets of the magnet carrier and the conductive member, wherein the beam, the magnet carrier and the one or more strain sensing members are configured and arranged such that the magnet carrier is spaced outwardly from the one or more strain sensing members in an axial direction parallel to the axis of rotation, and wherein the strain in the beam corresponds to the user input power.

11. The method of controlling a resistance arrangement as set forth in claim 10, further comprising the step of sensing a speed of rotation of the rotatable member, and calculating the user input power based on the sensed strain in the beam in combination with the speed of rotation of the rotatable member.

12. The method of controlling a resistance arrangement of claim 10, further comprising the step of adjusting the position of the magnet carrier relative to the conductive member in order to adjust the resistance of the resistance arrangement.

13. An exercise system, comprising:

a user input area that includes a pedal arrangement;

a rotatable member that rotates about an axis of rotation in response to an input force applied by a user on the pedal arrangement;

a conductive member that rotates in response to rotation of the rotatable member; and a resistance unit comprising a magnetic member positioned adjacent the conductive member at a location spaced radially outwardly of the axis of rotation, for providing eddy current resistance to rotation of the rotatable member in response to rotation of the conductive member; means for causing relative movement between the magnetic member and the conductive member for varying the eddy current resistance; and torque sensing means associated with the magnetic member, including a nonrotatable cantilever member defining an unsupported outer end with which the magnetic member is interconnected, and strain sensing means for sensing strain in the cantilever member, wherein the strain sensing means comprises one or more strain sensors interconnected with the cantilever member at a location radially outwardly of the axis of rotation and axially inwardly of the magnetic member.

14. The exercise system of claim 13, wherein the cantilever member comprises a beam having an outer end and a supported inner end, wherein the magnetic member is interconnected with the outer end of the beam and wherein the strain sensing means is secured to the beam inwardly of the outer end of the beam and outwardly of the inner end of the beam.

15. The exercise system of claim 14, wherein the means for causing relative movement between the magnetic member and the conductive member comprises an actuator interconnected with the inner end of the beam.

16. A power sensing resistance arrangement for an exercise device that includes an input area for applying user input power, comprising:

a rotatable member that rotates in response to the application of the user input power, wherein the rotatable member rotates about an axis of rotation;

a conductive member associated with the rotatable member, wherein the conductive member is formed of an electrically conductive material and rotates in response to rotation of the rotatable member; and a magnet assembly which cooperates with the conductive member to establish eddy currents to resist rotation of the rotatable member, wherein the magnet assembly includes a magnet carrier having one or more magnets located adjacent the conductive member at a location radially offset from the axis of rotation; a nonrotatable beam having a supported inner end and an unsupported outer end, wherein the inner end of the beam is fixed and wherein the magnet carrier is secured to the beam at a location axially outwardly of the supported inner end of the beam; one or more strain sensing members interconnected with the beam between the magnet carrier and the supported inner end of the beam; a mounting member secured to the inner end of the beam, wherein the mounting member is configured to support the inner end of the beam, and wherein the one or more strain sensing members comprise one or more strain gauges secured to the beam outwardly of the mounting member; and means for causing relative movement between the magnet carrier and the conductive member for varying the magnitude of the eddy current forces caused by rotation of the conductive member relative to the magnet carrier, wherein the means for causing relative movement between the magnet carrier and the conductive member comprises a linear actuator interconnected with the mounting member, and wherein the linear actuator is operable to axially move the beam, and thereby the magnet carrier, toward and away from the conductive member, and wherein the beam, the magnet carrier and the one or more strain sensing members are configured and arranged such that the magnet carrier is spaced outwardly from the one or more strain sensing members in an axial direction parallel to the axis of rotation, and wherein the beam, the magnet carrier and the one or more strain sensing members are spaced radially outwardly from the axis of rotation, and wherein the one or more strain sensing members are configured and arranged to sense strain experienced by the beam when the rotatable member is rotated to establish eddy current resistance by the interaction between the magnets of the magnet carrier and the conductive member, wherein the strain in the beam corresponds to the user input power.

17. The resistance arrangement of claim 16 wherein the linear actuator comprises a linear motor having an output member interconnected with the mounting member.

18. The resistance arrangement of claim 17 wherein the mounting member comprises a bracket that includes a tab, wherein the output member is secured to the tab.

19. The resistance arrangement of claim 18, wherein the linear motor is operated by electronic components carried by a circuit board to selectively move the magnet carrier relative to the conductive member.

* * * * *